US011335526B2

(12) United States Patent
Manfreda

(10) Patent No.: US 11,335,526 B2
(45) Date of Patent: May 17, 2022

(54) COIL CARRIER FOR AN ELECTROMAGNETIC SWITCH

(71) Applicant: Mahle International GmbH, Stuttgart (DE)

(72) Inventor: Dejan Manfreda, Kal Nad Kanalom (SI)

(73) Assignee: Mahle International GmbH

( * ) Notice: Subject to any disclaimer, the term of this patent is extended or adjusted under 35 U.S.C. 154(b) by 322 days.

(21) Appl. No.: 16/554,163

(22) Filed: Aug. 28, 2019

(65) Prior Publication Data

US 2020/0075281 A1 Mar. 5, 2020

(30) Foreign Application Priority Data

Aug. 28, 2018 (EP) ..... 18191255

(51) Int. Cl.
*H01H 50/44* (2006.01)
*H01F 27/28* (2006.01)

(52) U.S. Cl.
CPC ..... *H01H 50/443* (2013.01); *H01F 27/2866* (2013.01); *H01H 2050/446* (2013.01)

(58) Field of Classification Search
CPC ..... H01H 50/443; H01H 2050/446; H01H 50/44; H01H 51/065; H01F 27/2866; H01F 2005/022; H01F 7/1607; H01F 5/02; H01F 27/306; F02N 15/067; F02N 11/087
See application file for complete search history.

(56) References Cited

U.S. PATENT DOCUMENTS 3,597,715 A * 8/1971 Davis ..... H01F 5/02 336/176
3,661,342 A * 5/1972 Sears ..... H01F 5/02 242/118.41
4,405,913 A * 9/1983 Finkbeiner ..... H01F 27/306 336/198

(Continued)

FOREIGN PATENT DOCUMENTS

DE 2935109 A1 * 3/1980
DE 102004032373 A1 1/2006

(Continued)

OTHER PUBLICATIONS ip.com Search Results.*
Global Dossier.*
English abstract for DE-102004032373.

*Primary Examiner* — Mohamad A Musleh
(74) *Attorney, Agent, or Firm* — Fishman Stewart PLLC

(57) ABSTRACT

A coil carrier for an electromagnetic switch of a starting device including a cavity enclosed by a carrier wall for winding of a coil wire. The carrier wall may extend in an axial direction from a first end wall to a second end wall. The coil carrier may include at least one separating body protruding radially, and extending in a circumferential direction, on a side of the carrier wall facing away from the cavity. The at least one separating body may have a recess which separates a first separating body end of the at least one separating body from a second separating body end of the at least one separating body in the circumferential direction. The at least one separating body may have an axially extending body width that decreases along the circumferential direction.

19 Claims, 5 Drawing Sheets

(56) References Cited

U.S. PATENT DOCUMENTS

| | | | | |
|---|---|---|---|---|
| 4,857,877 | A * | 8/1989 | Dethienne | H01F 41/04 336/170 |
| 9,183,974 | B1 * | 11/2015 | Folker | H01F 27/306 |
| 2008/0180205 | A1 * | 7/2008 | Tsai | H01F 27/2866 336/192 |
| 2008/0290979 | A1 * | 11/2008 | Suzuki | H01F 41/076 336/192 |
| 2009/0278646 | A1 * | 11/2009 | Chen | H01F 27/325 336/177 |
| 2010/0231342 | A1 | 9/2010 | Zeng et al. | |
| 2010/0271155 | A1 * | 10/2010 | Kaneda | H01H 51/065 335/126 |
| 2011/0260562 | A1 | 10/2011 | Bradfield | |
| 2012/0068475 | A1 | 3/2012 | Bradfield | |
| 2017/0175696 | A1 * | 6/2017 | Florijancic | F02N 11/087 |
| 2020/0075279 | A1 * | 3/2020 | Manfreda | H01F 27/2823 |
| 2021/0012938 | A1 * | 1/2021 | Dams | H01F 7/126 |

FOREIGN PATENT DOCUMENTS

| | | | | |
|---|---|---|---|---|
| EP | 3131101 | A1 | | 2/2017 |
| GB | 592463 | A | * | 9/1947 |
| GB | 2148053 | A | | 5/1985 |
| GB | 2171562 | A | * | 8/1986 |

* cited by examiner

COIL CARRIER FOR AN ELECTROMAGNETIC SWITCH

CROSS-REFERENCE TO RELATED APPLICATION

This application claims priority to European Patent Application No. EP 18191255.1, filed Aug. 28, 2018, the contents of which are hereby incorporated by reference in its entirety.

TECHNICAL FIELD

The present invention relates to a coil carrier for an electromagnetic switch, which coil carrier has a carrier wall on which a coil wire of a coil winding is wound. The invention furthermore relates to an electromagnetic switch, in particular of a starting device, having a coil carrier of said type.

BACKGROUND

In general, a coil wire of a coil winding is wound on coil carriers or coil bodies in order to generate a magnetic field when the coil wire is electrically energized during operation. It is sought here for the coil carrier with the coil winding to be designed to take up the least possible structural space. This applies in particular to uses of the coil carrier in applications in which structural space is critical.

Such an application is the use of the coil carrier in an electromagnetic switch which is used in a starting device for starting an internal combustion engine. A generic coil carrier has a cavity which is enclosed by a carrier wall of the coil carrier, wherein the carrier wall extends in an axial direction, and wherein the coil wire of the coil winding is wound on the carrier wall.

When the coil carrier is used in an electromagnetic switch, it is desired here for the magnetic field generated by the coil winding during operation to be locally manipulated, in particular weakened. This manipulation serves in particular for the purposes of displacing a piston, which is arranged in axially adjustable fashion in the cavity of the coil carrier, with a low adjustment force in the direction of a core, which is generally likewise arranged in the cavity.

A coil carrier of said type is known from US 2011/0260562 A1. The coil carrier has a projection which protrudes radially from the carrier wall and which is arranged between end walls of the coil carrier. The projection serves for the purposes of separating, in the coil winding, a first winding section from a second winding section which is wound in the opposite direction.

EP 3 131 101 A1 has disclosed a coil body which has a separating body which protrudes radially from the carrier wall, and extends in a circumferential direction, between end walls of the coil body, wherein the separating body is equipped with a recess which serves for the leadthrough of the coil wire. Here, the separating body separates a first wall segment from a second wall segment of the carrier wall, wherein the wall segments are connected to one another by means of the recess. Winding sections can be wound in opposite winding directions onto the different wall segments.

US 2010/0231342 A1 has disclosed a coil carrier having a separating body which protrudes radially from the carrier wall and which extends in a circumferential direction and in the case of which separating body ends of the separating body which are separated from one another by the recess taper in a circumferential direction towards the recess.

SUMMARY

The present invention is concerned with the problem of specifying, for a coil carrier of the type mentioned in the introduction and for an electromagnetic switch having a coil carrier of said type, improved or at least alternative embodiments which are distinguished in particular by simplified winding, and/or winding which takes up less structural space, of a coil wire around the coil carrier.

Said object is achieved according to the invention by means of the subjects of the independent claim(s). The dependent claim(s) relate to advantageous embodiments.

The present invention is based on the general concept of forming a separating body, which protrudes radially from a carrier wall of a coil body and which extends in a circumferential direction, with an axial body width which decreases in the circumferential direction. The extent of the separating body in the circumferential direction together with the decreasing body with permits denser winding of a coil wire, which forms a coil winding, around wall segments, which are separated from one another by the separating body, of the carrier wall, and thus denser and more efficient filling of the coil carrier with the coil winding. The associated electromagnetic switch can thus take up little structural space and be of efficient design. This furthermore has the effect that the magnetic field generated by the coil winding during operation is stronger and can be more efficiently manipulated, in particular locally reduced. According to the concept of the invention, the coil carrier has a cavity which is enclosed by the carrier wall in a circumferential direction, wherein the carrier wall furthermore extends in an axial direction between end walls of the coil body. The carrier wall serves for the winding of the coil wire, which is wound on the carrier wall in order to produce the electromagnetic switch. The coil carrier furthermore has at least one separating body which protrudes radially from the carrier wall, and extends in a circumferential direction, on that side of the carrier wall which is averted from the cavity. The respective separating body furthermore has a recess or break which serves in particular for the leadthrough of the coil wire. The recess thus separates a first separating body end of the separating body from a second separating body end of the separating body in a circumferential direction. According to the invention, the axially running body width of the at least one separating body decreases along the circumferential direction.

In the present case, the stated directions relate to the axial direction. Here, axial means in the axial direction or parallel to the axial direction. Radial direction, and radial, mean perpendicular to the axial direction or perpendicular to the axial. The circumferential direction is also to be understood in relation to the axial direction or axial.

The end walls of the coil body expediently protrude radially, and run in a circumferential direction, in particular in closed fashion, at the axial end sides of the carrier wall. Here, the end walls advantageously have a greater radial extent than the at least one separating body. The carrier wall preferably extends in cylindrical form from a first end wall to a second end wall of the coil carrier.

The body width preferably decreases in a circumferential direction between one of the separating body ends and the other separating body end. Said decrease is preferably continuous. Denser winding of the coil wire on the carrier wall is thus made possible. It is furthermore advantageous if the body width decreases from one of the separating body ends to the other separating body end, in particular in continuous fashion, that is continuously.

In principle, the respective separating body may be a constituent part of the coil carrier which is separate from the carrier wall and which is connected to the coil body.

Embodiments are preferable in which the carrier wall and the respective separating body are produced in materially integral and unipartite form. In particular, the respective separating body is produced together with the carrier wall in a common process. The carrier wall and the respective separating body may for example be produced jointly in one casting process. The coil carrier can thus be produced inexpensively and in simplified fashion. It is furthermore preferable if the end walls of the coil carrier are also produced in unipartite fashion and materially integrally with the carrier wall and with the respective separating body, in particular by means of a casting process.

If the coil carrier has multiple separating bodies, these are expediently in each case spaced apart from one another in an axial direction.

At least one of the separating bodies may be arranged axially between end walls of the coil carrier of the carrier wall. A separating body of said type will therefore hereinafter also be referred to as intermediate separating body. By means of the respective intermediate separating body, one more segment of the carrier wall is separated axially from another wall segment of the carrier wall, wherein the wall segments that are thus separated are connected to one another by the recess of the separating body. A separating body of said type is in particular suitable for winding the coil wire in opposite directions on the wall segments that are separated from one another.

It is likewise conceivable for at least one of the separating bodies to be provided axially on the end side of the carrier wall. A separating body of said type will therefore hereinafter also be referred to as end separating body. With the end separating body, it is in particular possible for the coil wire to be wound more densely, and thus so as to take up less structural space, even in the region of the associated end wall.

The respective separating body has, axially at the end side, at least one face side or flank which extends along the circumferential direction. The respective intermediate separating body has two such flanks, which face axially away from one another. The respective end separating body has one or two such flanks.

Embodiments have proven to be advantageous in which at least one of the separating bodies has at least one flank which runs in a radially inclined manner and which thus forms an angle with a radial direction running transversely with respect to the axial direction, which angle will hereinafter be referred to as beta (B). Consequently, the body width of the separating body likewise decreases in the radial direction with increasing distance to the cavity. Thus, the coil wire can be wound even more densely, in particular can bear areally against the at least one flank. Furthermore, the carrier body can thus be produced more easily, in particular if the separating body is produced by means of a casting process.

It is self-evident that, in addition to the coil carrier, an electromagnetic switch having a coil carrier of said type also falls within the scope of this invention.

The electromagnetic switch is used in particular in a starting device for starting an internal combustion engine. In the case of the electromagnetic switch, the coil winding is produced by the winding of the coil wire on the carrier wall of the coil carrier. The switch furthermore advantageously has an in particular ferromagnetic piston, which is arranged in axially adjustable fashion in the cavity, and an in particular ferromagnetic core, which likewise arranged in the cavity. During operation, that is to say when the coil winding is electrically energized, a magnetic field is generated in the cavity, which magnetic field adjusts the piston in the direction of the core with an adjusting force.

Embodiments are advantageous in which the coil body has at least two such separating bodies, wherein the body widths of separating bodies arranged in succession in the axial direction decrease alternately from one separating body end to the other separating body end and vice versa. This means that, in the case of one separating body, the body with decreases from the first separating body end in the direction of the second separating body end, whereas the body width of the axially subsequent separating body decreases from the second separating body end in the direction of the first separating body end. It is thus possible in particular for the coil wire to be wound in opposite directions onto the wall segments that are separated from one another by the intermediate separating bodies. This means that the coil wire can be wound in a first winding direction on a first wall segment of the carrier wall, and can be wound in a second winding direction, which is opposite to the winding direction, in the axially adjacent wall segment. The reversal of the winding direction leads to a correspondingly different profile of the coil wire, to which the different body width profile of axially successive separating bodies is adapted in order that the coil wire can be wound as densely as possible on the respective wall segment.

It is preferable here if the coil wire is wound in the respective winding direction in the height region, running in a radial direction, of the respective separating body. This means in particular that the coil wire may have a first axial winding section, which is wound on a first wall segment in a first winding direction around the carrier wall, and a second winding section, which is wound on a second wall segment, which is separated from the first wall segment by an intermediate separating body, in a second winding direction which is opposite to the first winding direction. Here, the coil wire is led through the recess of the respective intermediate separating body. This permits denser winding of the coil wire on the carrier wall despite different winding directions in the different winding sections.

It is self-evidently also possible for multiple intermediate separating bodies to be provided, which each separate wall segments of the carrier wall, on which the coil wire is wound in opposite winding directions, from one another. It is for example conceivable for the coil carrier to have two intermediate separating bodies which are axially spaced apart from one another, wherein a first of the intermediate separating bodies separates a first wall segment from a second wall segment, and a second of the intermediate separating bodies separates the second wall segment from a third wall segment, wherein the recesses of the intermediate separating bodies connect the mutually separate wall segments to one another. Here, the coil wire is wound in the first winding direction on the first wall segment and thus forms the first winding section. The coil wire is led through the recess of the separating body that separates the first wall segment from the second wall segment, and is wound on the second wall segment in the second winding direction, which is opposite to the first winding direction, in order to form the second winding section. The coil wire is furthermore led through the recess of the separating body that separates the second wall segment from the third wall segment, and is wound on the third wall segment in the first winding direction in order to form a third winding section. This means that the third winding section corresponds to the first winding section, with the difference that, in the row in which the second winding section is arranged, the first winding section and the third winding section are arranged on axially mutually averted sides of the second winding section.

Embodiments have proven to be advantageous in which an extent at least one of the recesses in a circumferential direction corresponds to a dimension, running in the circumferential direction, of the coil wire. Thus, when led through the recess, the coil wire substantially fills the recess in the circumferential direction, and/or the coil wire is received in the recess in form-fitting fashion in the circumferential direction. This leads to denser winding of the coil wire around the carrier wall and/or to mechanical stabilization of the coil winding.

It is advantageous if a radially running separating body height of at least one of the separating bodies, preferably the respective separating body, corresponds to a radial dimension of the coil wire. Thus, the coil winding, in a first row axially adjoining the at least one separating body or separated axially from one another by the separating bodies, of the coil winding, is radially aligned with the at least one separating body. In this way, it is possible in particular for further rows, which follow the first row, of the coil winding to be wound, so as to take up little structural space and in an efficient manner, onto the first row.

For this purpose, the coil wire advantageously has a cross section which is substantially constant along the extent of the coil wire, in particular a circular cross section. Accordingly, the dimensioning of the coil wire in a radial direction is substantially constant along the coil wire.

Further important features and advantages of the invention will emerge from the subclaims, from the drawings and from the associated figure description based on the drawings.

It is self-evident that the features mentioned above and the features yet to be discussed below may be used not only in the respectively specified combination but also in other combinations or individually without departing from the scope of the present invention.

Preferred exemplary embodiments of the invention are illustrated in the drawings and will be discussed in more detail in the following description, wherein identical reference designations relate to identical or similar or functionally identical components.

BRIEF DESCRIPTION OF THE DRAWINGS

In the drawings, in each case schematically.

DETAILED DESCRIPTION

Figure 7:
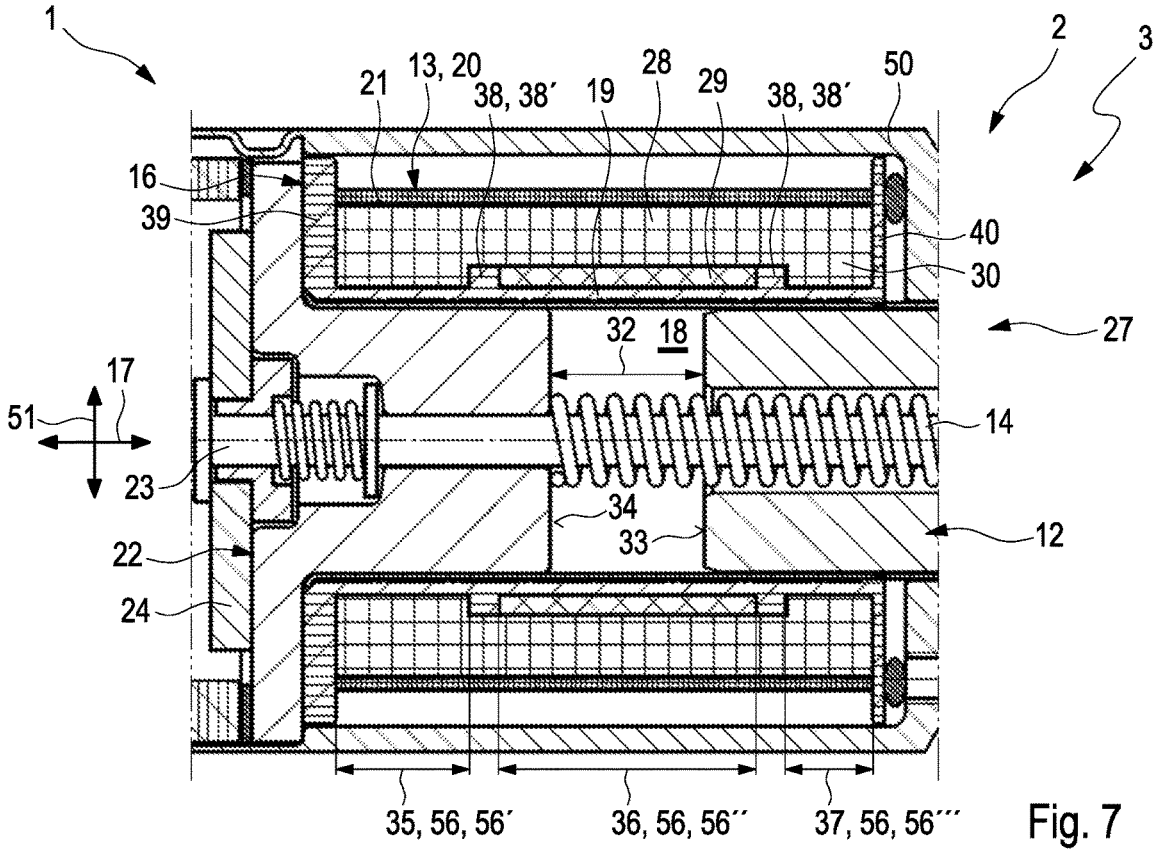
Figure 8:
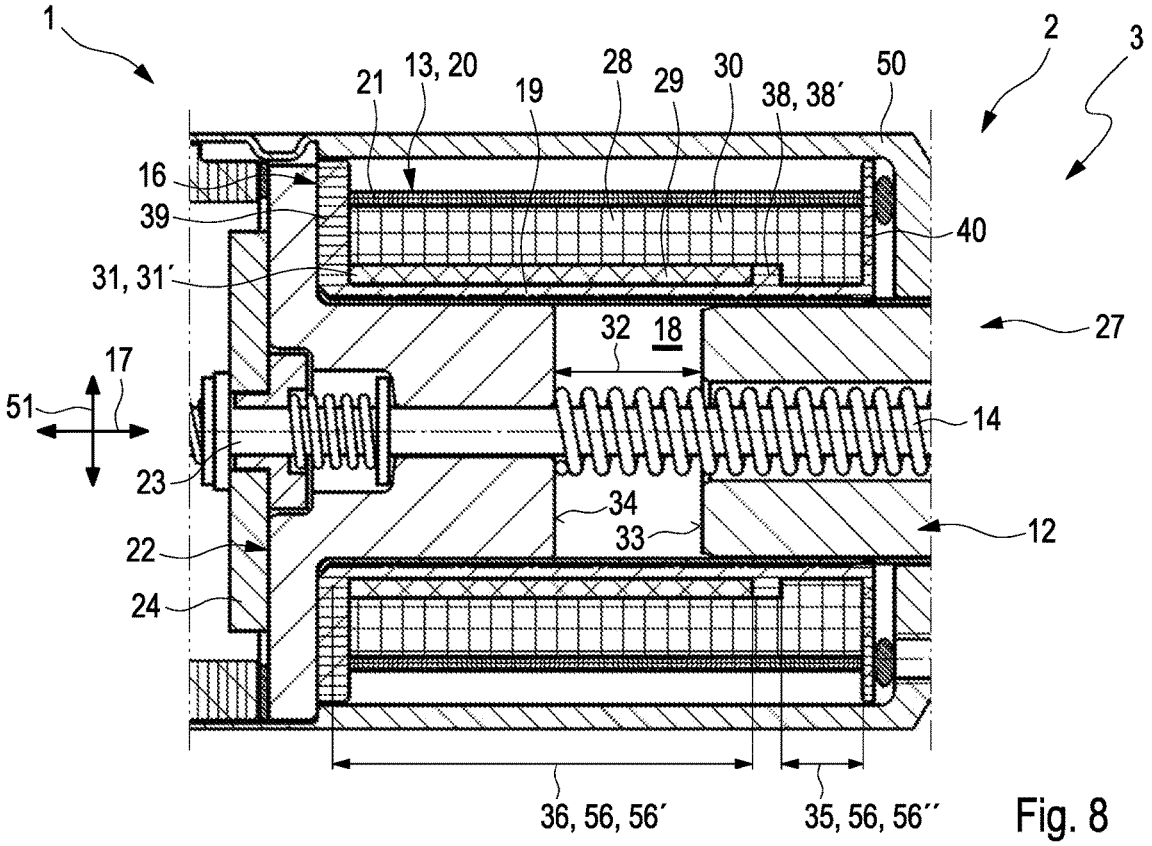
Figure 9:
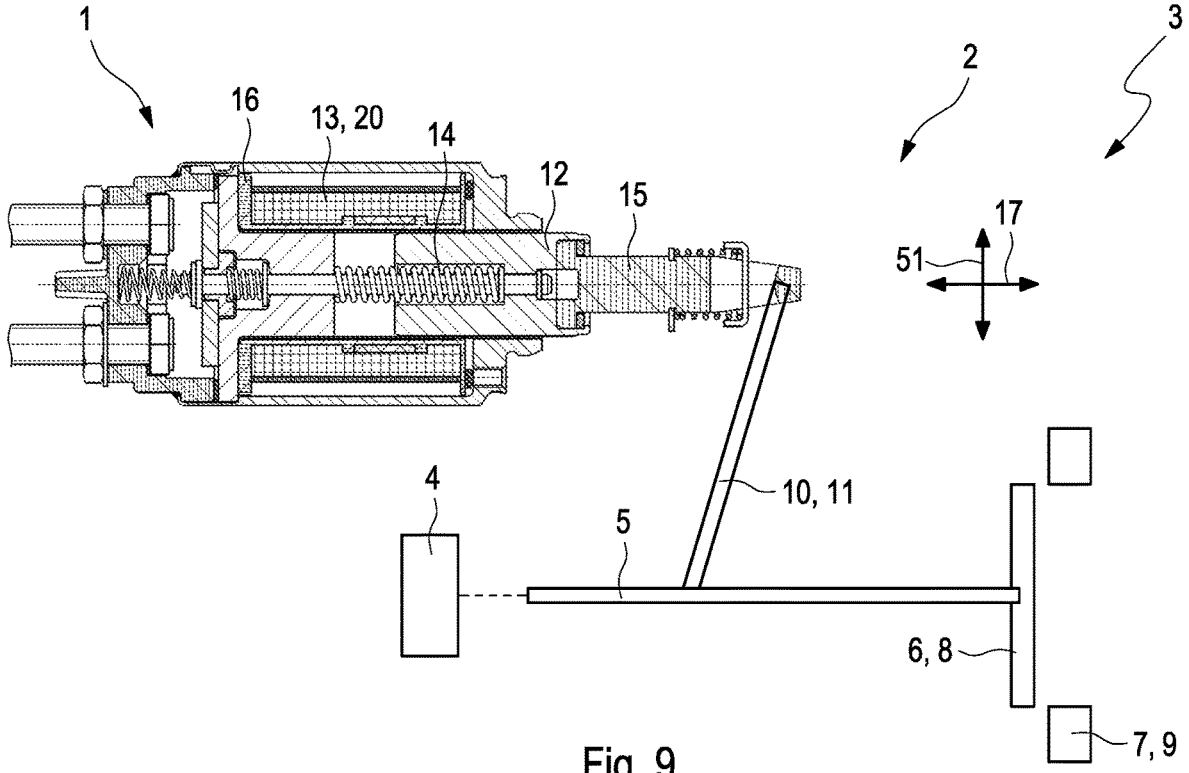
FIG. 9 shows a longitudinal section through a starting device of an internal combustion engine.

An electromagnetic switch 1, hereinafter also referred to for short as switch 1, as shown for example in FIGS. 1 to 9, is commonly a constituent part of a starting device 2 of an internal combustion engine 3, as shown by way of example in FIG. 9. The starting device 2 furthermore has an electrically operated motor 4 or electric motor 4 which, during operation, transmits a torque to a starting element 6 of the starting device 2, for example via a shaft 5, wherein the starting element 6 transmits said torque for starting the internal combustion engine 3 to a counterpart starting element 7. For the transmission of the torque, the starting element 6, which is formed for example as a pinion 8, and the counterpart starting element 7, which is formed for example as a ring gear 9, are placed in engagement. When the internal combustion engine 3 has been started, the engagement of the starting element 6 with the counterpart starting 7 is released. For this purpose, the starting element 6 is adjustable relative to the counterpart starting element 8. This adjustment is realized by means of the electromagnetic switch 1, which adjusts the starting element 6 via a coupling element 10, for example a lever 11. The coupling element 10 is connected in terms of drive to a piston 12 of the starting device 2 and is mounted such that an adjustment of the piston 12 in one axial direction 17 axially adjusts the starting element 6 in the opposite direction. For this purpose, the piston 12 is adjustable in the starting device 2 in the axial direction 17, and is thus axially adjustable, wherein the adjustment of the piston 12 in the axial direction 17 for the displacement of the starting element 6 in the direction of the counterpart starting element 7 is realized by means of a coil winding 13, and the adjustment of the starting element 6 away from the counterpart starting element 7 is realized by means of at least one spring 14 which acts on the piston 12. In the example shown, the piston 12 is in this case connected by means of a bolt 15, which is attached to the piston 12, to the coupling element 10.

The switch 1 has a coil carrier 16 which has a carrier wall 19, which carrier wall extends in cylindrical form in an axial direction 17 and encloses a cavity 18, and on which carrier wall the coil winding 13 is wound. In the example shown, the coil winding 13 extends from a radially projecting first end wall 39 to a radially projecting second end wall 40, which is situated axially opposite the first end wall 39, of the coil carrier 16. The end walls run in each case in closed form in a circumferential direction and are of disk-like form. Here, the coil winding 13 forms an attracting coil 20 of the switch 1. In the examples shown, the switch 1 furthermore has a holding coil 21, which is wound radially outside the coil winding 13. The coil winding 13 and the holding coil 21 are arranged in a housing 50 of the switch 1. When electrically energized, the coil winding 13 or the attracting coil 20 serves for the adjustment of the piston 12 in the direction of a core 22, which, like the piston 12, is accommodated in the cavity 18 but is fixed therein and is thus axially non-adjustable. For this purpose, during operation, that is to say when energized, the coil winding 13 and thus the attracting coil 20 and the holding coil 21 generate, within the cavity 18, a magnetic field which exerts an adjusting force on the piston 12 and thus adjusts said piston axially in the direction of the core 22. For this purpose, the piston 12 is at least partially, preferably entirely, ferromagnetic. With the holding coil 21, it is possible to hold the piston 12 in its respectively present position. The attracting coil 20 and the holding coil 21 in this case generate such a magnetic field, which subjects the piston 2 to an adjusting force opposed to the spring force of the at least one spring 14, that, for the adjustment of the piston 12 in the direction of the core 22, the spring force is overcome, and for the holding of the piston 12 in its present position, a compensation of the spring force is realized. The piston 12 is mechanically connected, by means of a connecting element 23 which is of rod-like form in the example shown, to a switching element 24. During the adjustment of the piston 12 in the direction of the core 12, which is likewise at least partially ferromagnetic, the switching element 24 is adjusted in the direction of electrical contacts 25, wherein the switching element 24, when it makes contact with the electrical contacts 25, electrically connects said contacts 25 to one another. Thus, an electrical connection is produced between two lines 26 by means of which electricity is supplied to the electric motor 4. Here, for the starting of the internal combustion engine 3, the coils 20, 21 are electrically energized, and here, displace the piston 12 in the direction of the core 22 until the switching element 24 produces an electrical connection between the electrical contacts 25. In this state, the electrical energization of the attracting coil 13 is stopped, and the holding coil 21 is electrically energized, in order to hold the piston 12 in position and thus maintain an electrical connection between the lines 26 that supply electricity to the electric motor 4. In this position, it is furthermore the case that the starting element 6 and the counterpart starting element 7 are in engagement, such that the electric motor 4 starts the internal combustion engine 3. When the internal combustion engine 3 has been started, the supply of electricity to the starting device 1 is stopped, such that no magnetic field is generated, and the spring force adjusts the piston 12 back into a passive position 27, which is illustrated in FIGS. 1 to 19. The passive position 27 of the piston 12 is thus the position in the absence of electrical energization of the electromagnetic switch 1. The starting device 2 is in this case connected such that the electrical current that flows through the switch 1 corresponds to the electrical current by means of which the electric motor 4 is driven. The magnetic field which is generated by the attracting coil 20, and thus the adjusting force that acts on the piston 12, and also the torque that is transmitted by means of the electric motor 4 to the starting element 6, are thus dependent on said electrical current. Here, there is a demand firstly to keep the torque of the electric motor 4 sufficiently high, or to increase said torque, such that the internal combustion engine 3 can be started in simplified fashion. Secondly, it is sought to reduce the adjusting force with which the piston 12 is adjusted in the direction of the core 22, in order to reduce damage to the starting element 6 and/or to the counterpart starting element 7, such as can arise during the production of the engagement of the starting element 6 with the counterpart starting element 7.

To reduce the adjusting force, the coil winding 13 which forms the attracting coil 20 is wound at least partially oppositely to the winding direction 28 with which the coil winding 13, when electrically energized, adjusts the piston 12 in the direction of the core 22, hereinafter referred to as first winding direction 28, specifically is wound at least partially in a second winding direction 29. A coil wire 30 of the coil winding 13 is thus wound partially in the first winding direction 28 and partially in the second winding direction 29, wherein the different winding directions 28, 29 are illustrated or indicated in FIGS. 1 and 2 and 6 to 9 by means of different hatchings of the coil winding 13.

In the examples shown, the coil wire 30 of the coil winding 13 is wound in multiple radially successive rows 31. Here, the row 31' situated closest to the cavity 18 is referred to as first row 31'.

In the passive position 27, the piston 12 is separated from the core 22 by an axial gap 32 running in an axial direction 17, which axial gap extends axially between a face side 33, facing toward the core 22, of the piston 12, hereinafter also referred to as piston face side 33, and a face side 34, facing toward the piston 12, of the core 22, hereinafter also referred to as core face side 34. Here, according to the invention, at least one of the windings wound in the second winding direction 29 is arranged so as to axially overlap the axial gap 32. Here, the coil wire 30 is, in a first axial winding section 35, wound in the first winding direction 28 around the carrier wall 19 and, in a second axial winding section 36, is wound in the second winding direction 29 around the carrier wall 19.

Here, the first winding section 35 is to be understood to mean that section of the coil winding 13 which is wound in the first winding direction 28 and thus extends axially. The second winding section 36 is that section of the coil winding 13 in which the coil wire 30 is wound in the second winding direction 29. Accordingly, the second winding section 36 extends axially. It is also possible for the second winding section to extend across multiple radially successive rows 31 of the coil winding 13.

In the examples shown, the coil wire 30 is furthermore, in a third axial winding section 37, likewise wound in the first winding direction 28 around the carrier wall 19, wherein the second winding section 36 is arranged axially between the first winding section 35 and the third winding section 37. The third winding section 37 thus corresponds to the first winding section 35, with the difference that, in the row 31 in which the second winding section 36 is arranged, the first winding section 35 and the third winding section 37 are arranged on axially mutually averted sides of the second winding section 36.

The transition between the first winding direction 28 and the second winding direction 29 is in each case separated by means of a separating body 38 of the coil carrier 16, which separating body protrudes radially from the carrier wall 19 and extends in a circumferential direction. The separating bodies 38 are arranged axially between the end walls 39, 40 and are arranged so as to be axially spaced apart from one another.

In the examples shown, the respective separating body 38 is formed and produced in unipartite fashion and integrally with the carrier wall 19. Here, the respective carrier wall 38 protrudes radially from the carrier wall 19, and extends in a circumferential direction, on that side of the carrier wall 19 which is averted from the cavity 18. It can be seen that the separating bodies 38 are dimensioned to be smaller in a radial direction 51 than the end walls 39, 40. In the examples shown, the coil carrier 16 is produced materially integrally and in unipartite fashion with the carrier wall 19, with the end walls 39, 40 and with the at least one carrier body 38 in a common production process, for example by means of a casting process.

Figure 1:
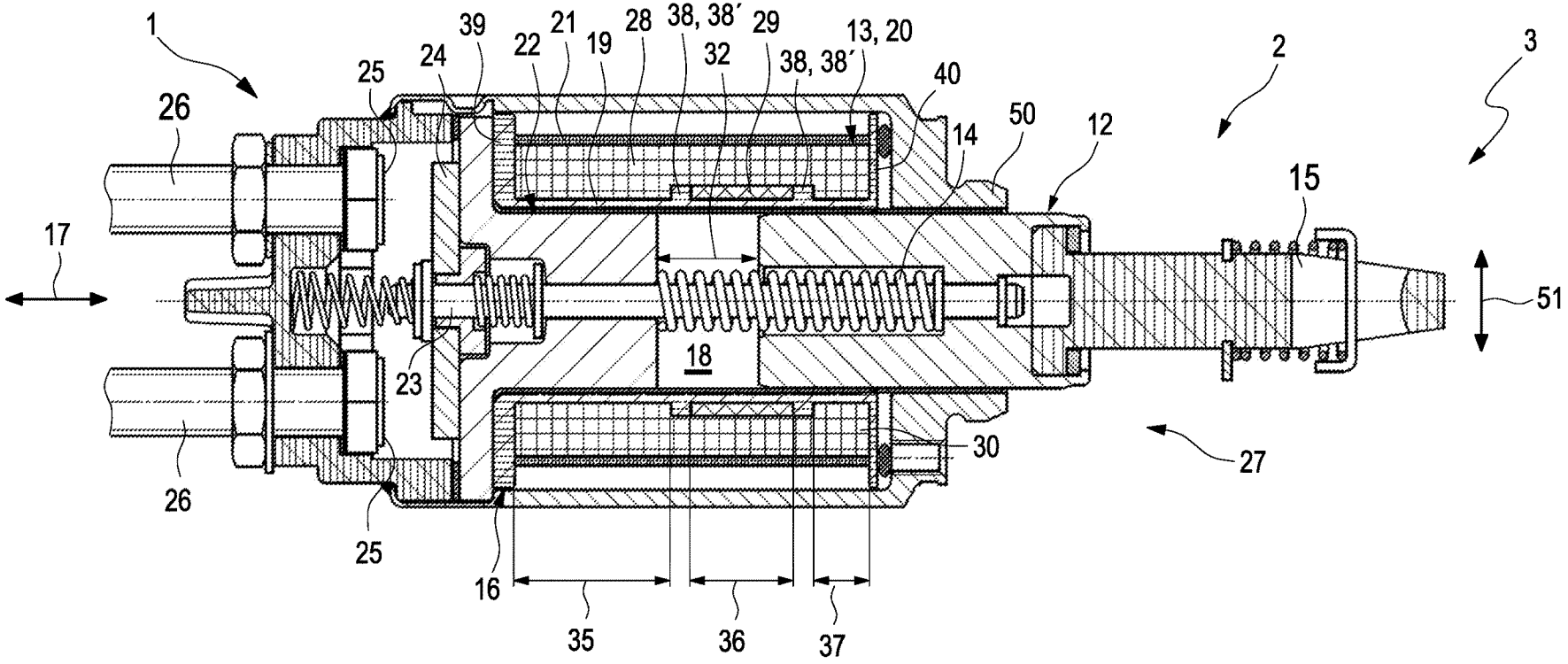
FIG. 1 shows a longitudinal section through an electromagnetic switch having a coil carrier.
Figure 2:
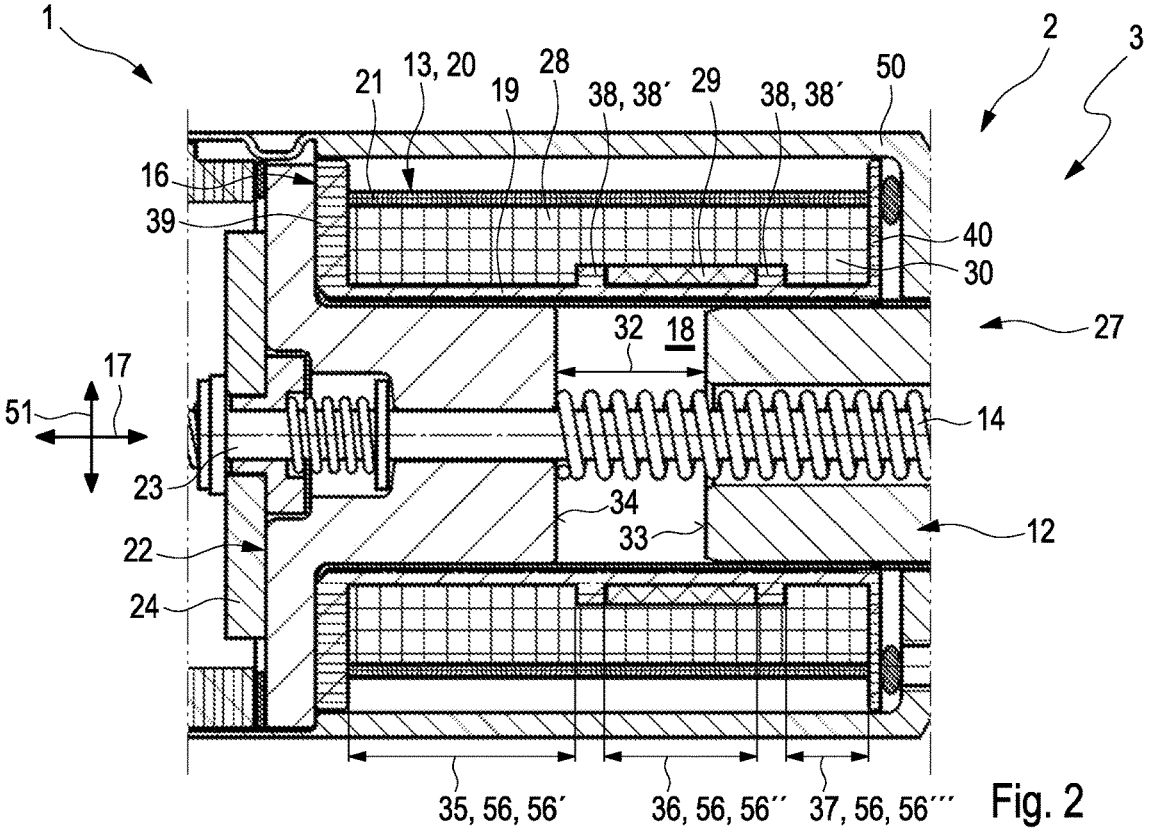
FIG. 2 is an enlarged illustration from FIG. 1.
Figure 3:
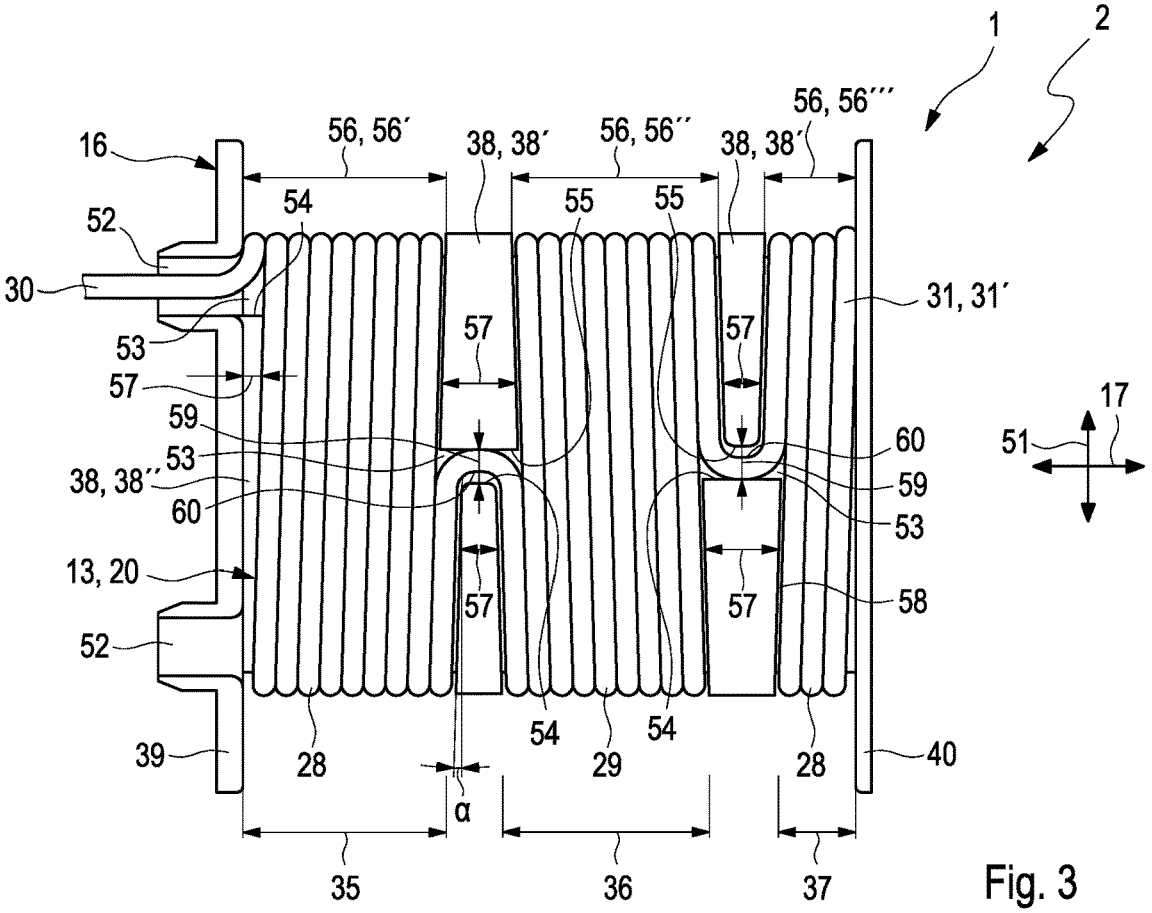
FIG. 3 shows a side view of the electromagnetic switch.
Figure 4:
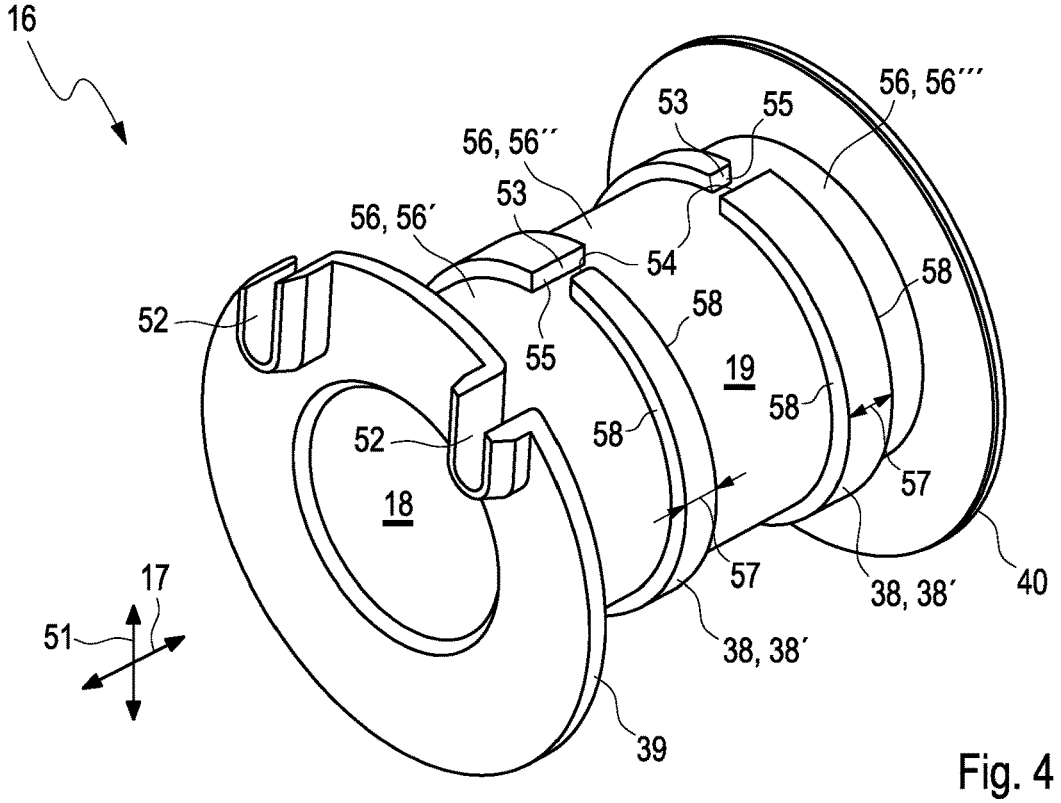
FIG. 4 shows an isometric view of the coil carrier.

FIG. 3 illustrates a side view of the electromagnetic switch 1 only with the coil wire 30 in the first row 31' and the coil carrier 16, and FIG. 4 illustrates an isometric view of the coil carrier 16. It can be seen that one of the end walls 39, 40, in the example shown the first end wall 39, has two recesses 52, formed as radial apertures, for the leadthrough of the coil wire 30. It can also be seen that, in addition to the separating sections 38 visible in FIGS. 1 and 2, which are arranged between the end walls 39, 40 and which will hereinafter also be referred to as intermediate separating bodies 38', a separating body 38 is also arranged axially on the end side of the carrier wall 19, and therefore in the example shown so as to axially adjoin the end wall 39, which will hereinafter also be referred to as end carrier wall 38". The respective separating body 38 extends in the circumferential direction and has, in the circumferential direction, a recess 53, which separates a first separating body end 54 from a second separating body end 55 of the separating body 38 in the circumferential direction. The respective intermediate separating body 38' in this case separates two wall segments 56 of the carrier wall 19 from one another in the axial direction 17, wherein the wall segments 56 that are separated in this way are connected to one another by means of the recess 53 of the separating body 38'. The recess 53 of the end separating body 38" is formed so as to transition into the leadthrough 52. Here, the coil wire 30 is introduced into the coil carrier via one of the leadthroughs 52 and via the recess 53 of the end separating body 38", wherein the winding of the coil wire 30 starts or ends in the region of the recess 53 of the end separating body 38". In the example shown, the coil carrier 16 has two intermediate separating bodies 38". A first of the separating bodies 38' in this case separates a first wall segment 56' of the carrier wall 19 axially from a second wall section 56" of the carrier wall. Furthermore, a second of the intermediate separating bodies 38' separates the second wall segment 56" axially from a third wall segment 56''' of the carrier wall 19. The first winding section 35 is wound in the first winding direction 28 on the first wall section 56', the second winding section 36 is wound in the second winding direction 29 on the second wall segment 56", and the third winding section 37 is wound in the first winding direction 28 on the third wall segment 56'''. Here, the coil wire 30 is led through the recess 53 of the respective intermediate separating body 38', such that a reversal of the winding direction 28, 29 is realized via the recess 53. Here, an axially running body width 57 of the respective separating body 38 decreases between one of the separating body ends 54, 55 and the other separating body end 54, 55, and thus along the circumferential direction. In the example shown, the body width 57 decreases continuously from one of the separating body ends 54, 55 to the other separating body end 54, 55.

In the example shown, the body widths 57 of axially successive separating bodies 38 decrease alternately from the first body end 54 to the second body end 55 and vice versa. In the example specifically shown, the body width 57 of the end separating body 38" decreases continuously from the first separating body end 54 to the second separating body end 55. In the case of the intermediate separating body 38' which follows the end separating body 38" and which separates the first wall segment 56' from the second wall segment 56", the body width 57 increases continuously from the first separating body end 54 to the second separating body end 55. In the case of the subsequent intermediate separating body 38', which separates the second wall segment 56" from the third wall segment 56''', the body width 57 decreases continuously from the first separating body end 54 to the second separating body end 55. Thus, despite alternating winding directions 28, 29, dense and in particular gapless winding of the coil wire 30 on the respective wall segment 56 is possible. The decreasing body with 57 of the respective separating body 38 is, in the examples shown, realized by means of a profile, which has an angle $\alpha$ in the circumferential direction, of at least one axial flank 58 of the respective separating body 38. In the case of the end separating body 38" that is shown, at least one of the flanks 58 has such a profile, whereas, in the case of the intermediate separating bodies 38', both flanks 58 have such a profile.

It can be seen in particular from FIG. 3 that a spacing 59, running in the circumferential direction, between the separating body ends 54, 55 of the respective separating body 38, in particular of the respective intermediate separating body 38', is dimensioned and configured such that the coil wire 30, as it passes through the recess 53 and reverses the winding direction 28, 29, fills the recess 53 in substantially form-fitting fashion in the circumferential direction. It can also be seen that, in the respective recess 53, the separating body end 54, 55 against which the coil wire 30 bears owing to the inner contour 60 shaped by the reversal of the winding direction 28, 29 is that separating body end 54, 55 which has the smaller or minimum body width 57. In the example shown, therefore, in the case of the separating body 38' which separates the first wall segment 56' from the second wall segment 56", the first separating body end 54 is that which has the relatively small, in particular minimum, body width 57, whereas, in the case of the other intermediate separating body 38', the second separating body end 55 has the relatively small, in particular minimum, body width 57 of the intermediate separating body 38'. This, too, leads to easier winding of the coil wire 30, and to improved stability of the coil winding 30. It can also be seen that the separating body end 54, 55 against which the coil wire 30 bears with the inner contour 60 is of rounded form.

It can also be seen from FIG. 3 that a radially running extent of the respective separating body 38 corresponds substantially to a radial extent of the coil wire 30, such that the separating bodies 38 are aligned axially with the illustrated first row 31' of the coil wire 30, such that the row 31 of the coil wire 30 wound onto the first row 31' can be wound in gapless and dense fashion. In the examples shown, it is thus the case that a radial separating body height 61 (see FIG. 5) of the respective separating body 38 corresponds substantially to the radial dimension or extent of the coil wire 30.

Figure 5:
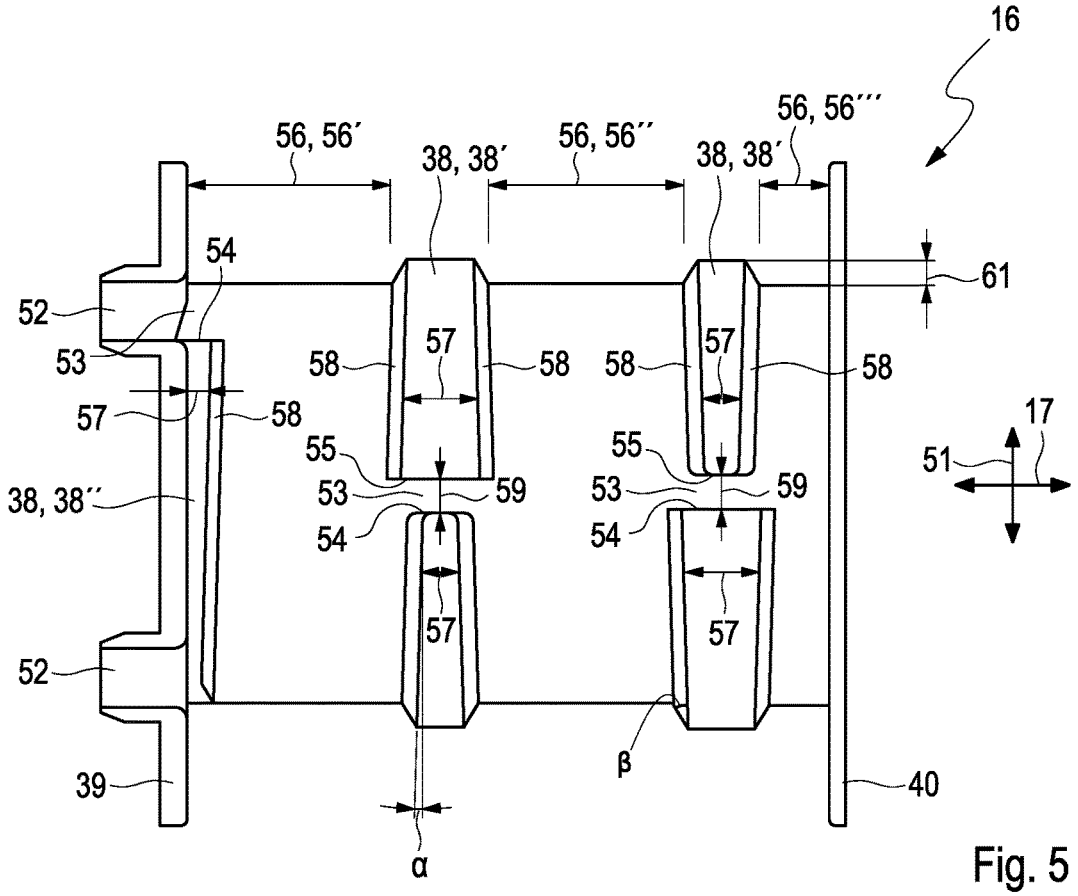
FIG. 5 shows a side view of the coil carrier in the case of a different exemplary embodiment.

A further exemplary embodiment of the coil body 16 is illustrated in FIG. 5. This exemplary embodiment differs from the exemplary embodiment shown in FIGS. 1 to 4 in that the flanks 58 of the separating bodies 38 each run in radially inclined fashion, and in the example shown each run so as to be inclined radially toward the other flank 58. The respective flank 58 thus forms an angle $\beta$ with the radial direction 51. Consequently, the body width 57 of the respective separating body 38 also decreases in the radial direction 51 away from the cavity 18. This permits, in particular, a more gapless and denser winding of the coil wire 30 onto the carrier wall 19, and simplified production of the coil carrier 16.

In the examples shown in FIGS. 1 to 5, the intermediate separating bodies 38' are arranged such that the second wall segment 56" is spaced apart axially from the core 22 and has been relocated toward the piston 12. Furthermore, the third wall segment 56''' is axially smaller than the first wall segment 56' and than the second wall segment 26". Accordingly, the second winding section 36 of the coil wire 30 wound in the second winding direction 29 is arranged so as to be spaced apart axially from the core 22 and so as to overlap the piston 12.

It is self-evidently possible for the respective separating bodies 38, in particular intermediate separating bodies 38', it also run in an axially offset manner in order to change the position of the corresponding wall segments 56 or winding sections 35, 36, 37 relative to the core 22, to the piston 12 and to the axial gap 32.

Figure 6:
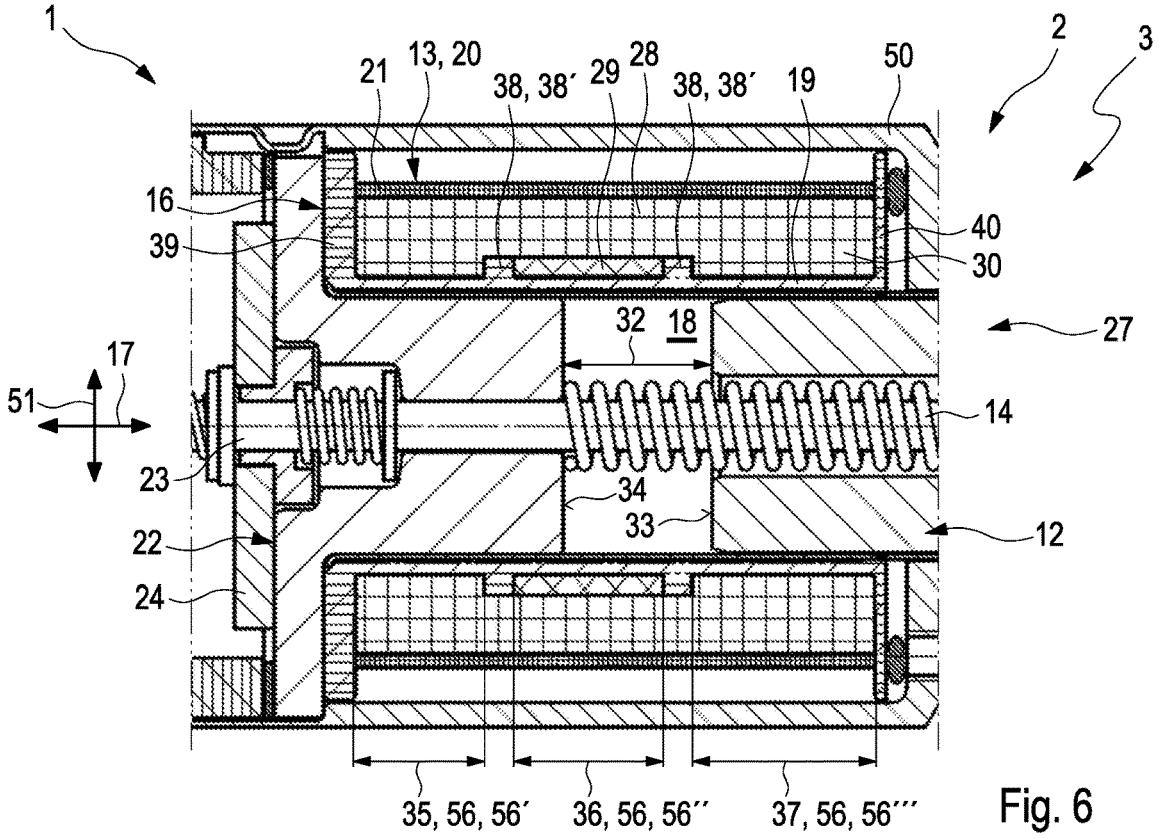
FIGS. 6 through 8 show the view from FIG. 2, in the case of a different exemplary embodiment in each case.

FIG. 6 illustrates an example which differs from the example shown in FIGS. 1 to 4 in that the intermediate separating bodies 38' have in each case been relocated axially toward the first end wall 39 and thus axially toward the core 22. Thus, the second winding section 36 has been relocated axially toward the core 22, such that the windings, wound in the second winding direction 29, of the second winding section 36 partially axially overlap the axial gap 32 and partially axially overlap the core 22.

FIG. 7 differs from the example shown in FIGS. 1 to 5 merely in that the intermediate separating body 38', which separates the first wall segment 56' from the second wall segment 56", has been relocated axially toward the first end wall 39 and thus axially toward the core 22. Thus, the second wall segment 56" and consequently the second winding section 36, wound in the second winding direction 29, of the winding wire 30 have been axially enlarged, such that the second winding section 36 axially overlaps the axial gap 32 and the piston 12 and the core 22.

The example shown in FIG. 8 differs from the exemplary embodiments shown in FIGS. 1 to 5 in that only one intermediate separating body 38' is provided, wherein said intermediate separating body 38' is arranged axially toward the piston 12 and so as to axially overlap the piston 12. Accordingly, in this example, the carrier wall 19 has only two wall segments 56, specifically a first wall segment 56', on which, in the example shown, the second winding section 36 of the coil wire 30 is wound in the second winding direction 29, and a second wall segment 56", on which the first winding section 35 of the coil wire 30 is wound in the first winding direction 29.

The invention claimed is:

1. A coil carrier for an electromagnetic switch of a starting device, comprising:

a cavity enclosed by a carrier wall for winding of a coil wire, the carrier wall extending in an axial direction from a first end wall to a second end wall;

at least one separating body protruding radially, and extending in a circumferential direction, on a side of the carrier wall facing away from the cavity;

the at least one separating body having a recess which separates a first separating body end of the at least one separating body from a second separating body end of the at least one separating body in the circumferential direction;

wherein the at least one separating body has an axially extending body width that decreases along the circumferential direction; and wherein the at least one separating body has at least one axial flank extending in a radially inclined manner and that forms an angle with a radial direction extending transversely with respect to the axial direction, such that the body width of the at least one separating body decreases in the radial direction.

2. The coil carrier according to claim 1, wherein the body width decreases in continuous fashion along the circumferential direction between one of the first separating body end and the second separating body end and the other of the first separating body end and the second separating body end.

3. The coil carrier according to claim 1, wherein the at least one separating body is structured as an intermediate separating body arranged axially between the first end wall and the second end wall and that separates a plurality of wall segments of the carrier wall axially from one another, and wherein the plurality of wall segments are connected to one another by the recess of the intermediate separating body.

4. The coil carrier according to claim 1, wherein the at least one separating body is structured as an end separating body arranged axially on an end side of the carrier wall and protruding axially from one of the first end wall and the second end wall.

5. The coil carrier according to claim 1, wherein the at least one separating body includes at least two separating bodies disposed axially spaced apart from one another, wherein the body width of each of the at least two separating bodies arranged in succession in the axial direction decreases alternately from one of the first separating body end and the second separating body end to the other of the first separating body end and the second separating body end.

6. The coil carrier according to claim 1, wherein the at least one separating body includes a plurality of separating bodies disposed axially spaced apart from one another, wherein the body width of adjacent separating bodies of the plurality of separating bodies decreases in opposing circumferential directions.

7. An electromagnetic switch for a starting device of an internal combustion engine, comprising:

a coil carrier including:

a cavity enclosed by a carrier wall for winding of a coil wire, the carrier wall extending in an axial direction from a first end wall to a second end wall;

a plurality of separating bodies protruding radially from and extending in a circumferential direction on a side of the carrier wall facing away from the cavity;

each separating body of the plurality of separating bodies having a recess which separates a first separating body end of the separating body from a second separating body end of the separating body in the circumferential direction; and each separating body of the plurality of separating bodies having an axially extending body width that decreases along the circumferential direction;

a coil winding including the coil wire wound on the side of the carrier wall facing away from the cavity;

wherein the coil wire, during operation, is flowed through by an electrical current and provides a magnetic field within the cavity;

wherein the plurality of separating bodies are disposed axially spaced apart from one another; and wherein the body width of axially adjacent separating bodies of the plurality of separating bodies decreases in opposite circumferential directions.

8. The electromagnetic switch according to claim 7, wherein:

at least one of the plurality of separating bodies is structured as an intermediate separating body arranged axially between the first end wall and the second end wall and that separates a first wall segment of the carrier wall from a second wall segment of the carrier wall;

the coil wire has a first axial winding section wound on one of the first wall segment and the second wall segment in a first winding direction, and a second axial winding section wound on the other of the first wall segment and the second wall segment in a second winding direction which is opposite the first winding direction, such that the coil wire is disposed around the carrier wall; and the coil wire extends through the recess of the intermediate separating body.

9. The electromagnetic switch according to claim 8, wherein:

the plurality of separating bodies includes two intermediate separating bodies disposed axially spaced apart from one another, a first intermediate separating body of the two intermediate separating bodies separating the first wall segment from the second wall segment, and a second intermediate separating body of the two intermediate separating bodies separating the second wall segment from a third wall segment of the carrier wall;

the coil wire is arranged such that the first winding section is disposed on the first wall segment, the second winding section is disposed on the second wall segment, and a third winding section of the coil wire is disposed on the third wall segment, the third winding section wound in the first winding direction; and the coil wire extends through the recess of each of the two intermediate separating bodies.

10. The electromagnetic switch according to claim 8, wherein an extent of the recess of the separating body in the circumferential direction corresponds to a dimension, extending in the circumferential direction, of the coil wire, such that the coil wire is received in the recess in a form-fitting manner in the circumferential direction.

11. The electromagnetic switch according to claim 7, wherein a radially extending separating body height of at least one of the plurality of separating bodies corresponds to a radial dimension of the coil wire.

12. The electromagnetic switch according to claim 7, wherein the body width decreases in continuous fashion along the circumferential direction between one of the first separating body end and the second separating body end and the other of the first separating body end and the second separating body end.

13. The electromagnetic switch according to claim 7, wherein at least one of the plurality of separating bodies is structured as an intermediate separating body arranged axially between the first end wall and the second end wall and that separates a plurality of wall segments of the carrier wall axially from one another, and wherein the plurality of wall segments are connected to one another by the recess of the intermediate separating body.

14. The electromagnetic switch according to claim 7, wherein the at least one separating body is structured as an end separating body arranged axially on an end side of the carrier wall and protruding axially from one of the first end wall and the second end wall.

15. The electromagnetic switch according to claim 7, wherein at least one separating body of the plurality of separating bodies has at least one axial flank extending in a radially inclined manner and that forms an angle with a radial direction extending transversely with respect to the axial direction, such that the body width of the at least one separating body decreases in the radial direction.

16. The electromagnetic switch according to claim 7, wherein the body width of each of the plurality of separating bodies arranged in succession in the axial direction decreases alternately from one of the first separating body end and the second separating body end to the other of the first separating body end and the second separating body end.

17. A coil carrier for an electromagnetic switch of a starting device, comprising:

a carrier wall extending axially from a first end wall to a second end wall configured to retain a coil wire, the carrier wall circumferentially enclosing a cavity;

at least one separating body protruding radially from a radially outward facing surface of the carrier wall and extending at least partially around the carrier wall in a circumferential direction;

the at least one separating body having a first separating body end and a second separating body end defining a recess circumferentially therebetween; and wherein an axial body width of the at least one separating body decreases along the circumferential direction from the first separating body end to the second separating body end.

18. The coil carrier according to claim 17, wherein:

the at least one separating body includes a plurality of intermediate separating bodies arranged axially spaced apart from one another between the first end wall and the second end wall, a first intermediate separating body of the plurality of intermediate separating bodies separating a first wall segment of the carrier wall from a second wall segment of the carrier wall, and a second intermediate separating body of the plurality of intermediate separating bodies separating the second wall segment from a third wall segment of the carrier wall; and the recess of the first intermediate separating body facilitates passage of the coil wire from the first wall segment to the second wall segment and reversal of a winding direction of the coil wire, and the recess of the second intermediate separating body facilitates passage of the coil wire from the second wall segment to the third wall segment and reversal of the winding direction of the coil wire.

19. The coil carrier according to claim 18, the at least one separating body further includes at least one end separating body arranged axially adjacent to one of i) the first end wall of the carrier wall and ii) the second end wall of the carrier wall.

* * * * *